US007819066B2

(12) United States Patent
Smith

(10) Patent No.: US 7,819,066 B2
(45) Date of Patent: Oct. 26, 2010

(54) ZIPLINE TROLLEY

(76) Inventor: Kevin Geoffrey Smith, 35 Retta Court, Whistler, British Columbia (CA) V0N 1B1

( * ) Notice: Subject to any disclaimer, the term of this patent is extended or adjusted under 35 U.S.C. 154(b) by 121 days.

(21) Appl. No.: 12/239,959

(22) Filed: Sep. 29, 2008

(65) Prior Publication Data

US 2009/0223406 A1 Sep. 10, 2009

Related U.S. Application Data

(60) Provisional application No. 60/975,942, filed on Sep. 28, 2007.

(51) Int. Cl.
*B61B 7/00* (2006.01)

(52) U.S. Cl. ..... 104/112; 104/113; 104/115; 104/53; 105/148

(58) Field of Classification Search ..... 104/112, 104/113, 115, 53; 105/148, 150; 472/122, 472/123

See application file for complete search history.

(56) References Cited

U.S. PATENT DOCUMENTS

| | | | | | |
|---|---|---|---|---|---|
| 245,893 | A * | 8/1881 | Tunnington | 472/123 |
| 479,524 | A * | 7/1892 | Nicholson | 472/123 |
| 547,528 | A * | 10/1895 | Weaver et al. | 105/91 |
| 654,687 | A * | 7/1900 | Suter | 104/22 |
| 1,087,062 | A * | 2/1914 | Izett | 104/115 |
| 1,087,063 | A * | 2/1914 | Izett | 104/115 |
| 1,228,694 | A * | 6/1917 | Netcott | 472/120 |
| 1,490,619 | A * | 4/1924 | Manikowske et al. | 472/120 |
| 1,873,196 | A * | 8/1932 | Harris et al. | 104/112 |
| 2,812,010 | A * | 11/1957 | Abdallah | 482/69 |
| 3,040,678 | A * | 6/1962 | McEwen | 105/150 |
| 3,070,035 | A * | 12/1962 | Russo et al. | 104/113 |
| 3,192,872 | A * | 7/1965 | Parent | 104/93 |
| 3,480,272 | A * | 11/1969 | Ziebart | 472/20 |
| 4,062,293 | A * | 12/1977 | Davis | 104/113 |
| 4,159,113 | A * | 6/1979 | Callecod | 482/36 |
| 4,948,118 | A * | 8/1990 | Miraglia | 482/55 |
| 5,113,768 | A * | 5/1992 | Brown | 104/112 |
| 5,701,824 | A * | 12/1997 | Johnson et al. | 104/112 |
| 5,931,100 | A * | 8/1999 | Sutton et al. | 104/53 |
| 6,363,858 | B1 * | 4/2002 | Voirin | 104/173.1 |
| 7,624,684 | B2 * | 12/2009 | Morris | 104/112 |
| 2008/0178760 | A1 * | 7/2008 | Frangos et al. | 104/112 |
| 2008/0202375 | A1 * | 8/2008 | Quattlebaum | 104/112 |
| 2009/0223406 | A1 * | 9/2009 | Smith | 104/112 |

* cited by examiner

*Primary Examiner*—S. Joseph Morano
*Assistant Examiner*—Jason C Smith
(74) *Attorney, Agent, or Firm*—Smiths IP; Lawrence Chan

(57) ABSTRACT

The present invention discloses a zipline trolley comprising of two substantially flat side flanges arranged in a parallel configuration, a substantially flat front face attached perpendicularly to the front edges of the side flanges, and a substantially flat back face attached perpendicularly to the rear edges of the side flanges. There are also provided two axles for bearing wheels and four lines for attaching the side flanges to the two spreaders. One set of two lines is attached to the bottom of each of the side flanges. The lines are connected to two spreaders, which are attached to the ends of a handlebar.

15 Claims, 3 Drawing Sheets

ZIPLINE TROLLEY

CROSS-REFERENCE TO RELATED APPLICATIONS

This application claims the benefit of U.S. Provisional Application No. 60/975,942, filed Sep. 28, 2007, the contents of which are hereby incorporated by reference.

FIELD OF THE INVENTION

The present invention relates to zipline trolleys.

BACKGROUND OF THE INVENTION

Zipline systems typically comprise a trolley that rolls along a suspended length of cable. A conventional trolley is constructed from a cylindrical aluminum frame enclosing two wheels. These wheels roll along the top of the cable. A handlebar is suspended from the bottom of the aluminum frame by four lines. One or more slings may also be used to attach the trolley to the user. The front of the trolley comprises a pair of vertical rings extending away from the trolley. The rings are used to engage the braking mechanism at the end of the cable length.

The conventional trolley is bulky and heavy, making it difficult to transport it from one end of the cable to the other. The design of the trolley also makes it difficult to remove and replace the wheels, lines, and slings, which is periodically necessary to allow for replacement due to wear and tear.

SUMMARY OF THE INVENTION

In one aspect of the present invention, a zipline trolley comprises a substantially flat first side flange and a substantially flat second side flanged arranged in a parallel configuration, with a substantially flat front face attached perpendicularly to the front edges of the first and second side flanges and a substantially flat back face attached perpendicularly to the rear edges of the first and second side flanges. Two axles are provided for bearing wheels, with the axles arranged in a spaced arrangement between the first and second side flanges. There are four lines comprised of a first two lines, with one end of each of the first two lines attached to the first side flange, and a second two lines, with one end of each of the second two lines attached to the second side flange. There are also provided a first spreader, which is attached to the other end of each of the first two lines, and a second spreader, which is attached to the other end of each of the second two lines. The ends of a handlebar are attached to the two spreaders.

In another aspect of the invention, the four lines are attached to the two side flanges using a swage eye toggle assembly.

In yet another aspect of the invention, the spreaders are weldedly connected to the ends of the handlebar.

In another aspect of the invention, the side flanges each comprise one or more holes that are adapted to allow for gripping the zipline trolley.

The foregoing was intended as a broad summary only and of only some of the aspects of the invention. It was not intended to define the limits or requirements of the invention.

Other aspects of the invention will be appreciated by reference to the detailed description of the preferred embodiment and to the claims.

BRIEF DESCRIPTION OF THE DRAWINGS

The invention will be described by reference to the detailed description of the preferred embodiment and to the drawings thereof in which.

DETAILED DESCRIPTION OF THE PREFERRED EMBODIMENT

The present invention comprises a trolley that is lighter and more compact than the conventional trolley. This trolley also allows for the easier removal and replacement of the wheels, lines, and slings.

Figure 1:
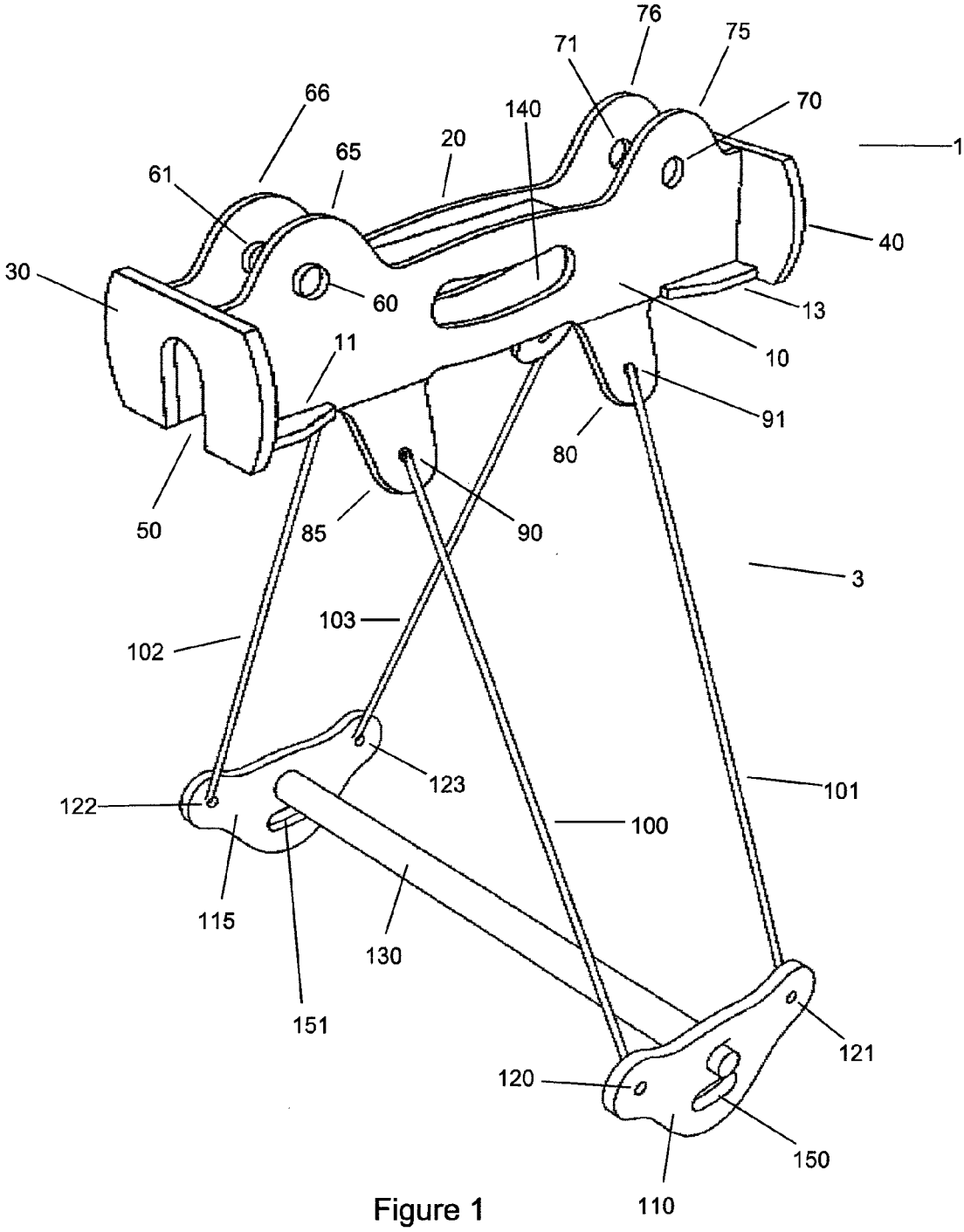
FIG. 1 is a perspective view of the trolley according to the preferred embodiment of the invention.

Referring to FIG. 1, the trolley of the present invention comprises an upper frame 1 with a substantially flat left flange 10 and a substantially flat right flange 20 arranged parallel with each other. The front edge of left flange 10 and the front edge of right flange 20 are rigidly attached to a substantially flat front face 30, while the rear edge of left flange 10 and the rear edge of right flange 20 are rigidly attached to a substantially flat back face 40. Preferably, the front edge of left flange 10 forms a right angle with flat front face 30, and the front edge of right flange 20 forms a right angle with flat front face 30. Similarly, the rear edge of left flange 10 preferably forms a right angle with flat back face 40, and the rear edge of right flange 20 forms a right angle with flat back face 40. As a result, left flange 10, right flange 20, front face 30, and back face 40 form a generally box-like configuration.

Figure 3:
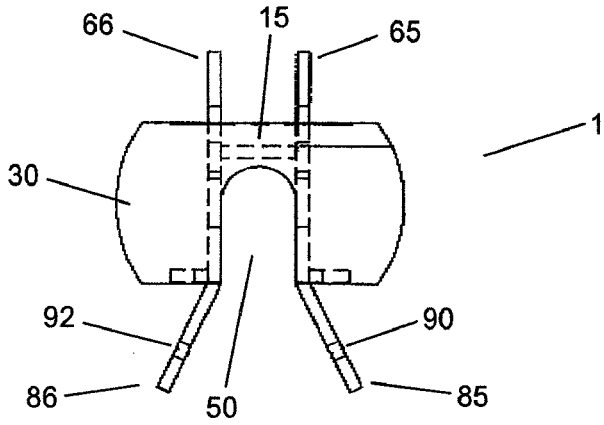
FIG. 3 is a side view of the upper frame of the trolley according to the preferred embodiment of the invention.

Front face 30 comprises a front slit 50, and back face 40 comprises a back slit 55. Front slit 50 extends vertically from approximately midway along the bottom edge of front face 30 to approximately the center of front face 30. Similarly, back slit 55 extends vertically from approximately midway along the bottom edge of back face 40 to approximately the center of back face 40. Front slit 50 and back slit 55 are of sufficient width to allow front face 30 and back face 40, respectively, to accommodate the diameter of a zipline cable 2. Preferably, the tops of front slit 50 and back slit 55 are semi-circular in shape. Referring to FIG. 3, front slit 50 and back slit 55 are horizontally aligned with each other to allow for zipline cable 2 to run through front face 30 and back face 40. Left flange 10 and right flange 20 are spaced sufficiently apart so that zipline cable 2 can pass between them.

Figure 2:
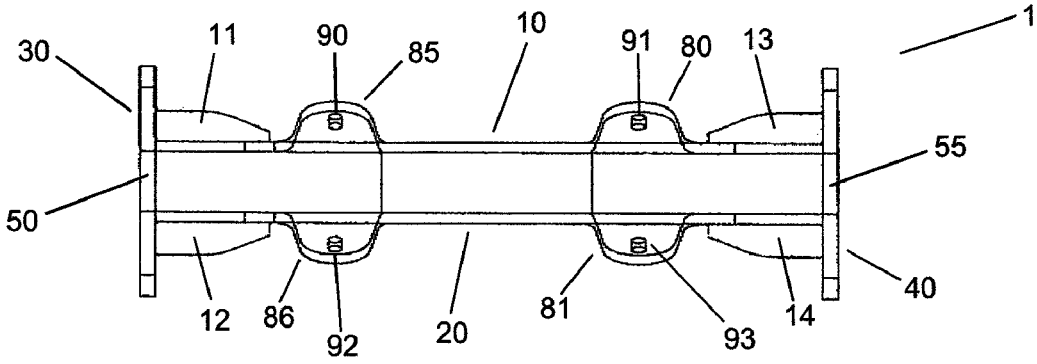
FIG. 2 is a bottom view of the upper frame of the trolley according to the preferred embodiment of the invention.

Preferably, one edge of a substantially flat member 15 is rigidly attached at a right angle to the inner surface of left flange 10. The opposite edge of substantially flat member 15 is rigidly attached at a right angle to the inner surface of right flange 20. Substantially flat member 15 therefore extends between left flange 10 and right flange 20 and provides strength and rigidity to the structure of upper frame 1. Referring to FIG. 2, preferably, a first corner member 11 is attached perpendicularly to the outside of the joint between left flange 10 and front face 30. Preferably, a second corner member 12 is attached perpendicularly to the outside of the joint between right flange 20 and front face 30. Preferably, a third corner member 13 is attached perpendicularly to the outside of the joint between left flange 10 and back face 40. Preferably, a fourth corner member 14 is attached perpendicularly to the outside of the joint between right flange 20 and back face 40. corner members 11, 12, 13, 14 are attached perpendicularly to the outside of the joints between the left flange 10 and the front face 30, between the left flange 10 and the back face 40, between the right flange 20 and the front face 30, and between the right flange 20 and the back face 40. Corner members 11, 12, 13, 14 add rigidity to the box-like configuration of the upper frame 1. Preferably, the left flange 10, the right flange 20, the front face 30, the rear face 40, the substantially flat member 15, and the corner members 11, 12, 13, 14 are made of an aluminum alloy, to reduce the overall weight of the trolley.

Along the top edge of left flange 10 are a left front protrusion 65 and a left rear protrusion 75, spaced apart from each other. Similarly, along the top edge of right flange 20 are a right front protrusion 66 and a right rear protrusion 76, again spaced apart from each other. Left front protrusion 65 comprises a left front axle hole 60, while left rear protrusion 75 comprises a left rear axle hole 70. Similarly, right front protrusion 66 comprises a right front axle hole 61, while right rear protrusion 76 comprises a right rear axle hole 71. Left front axle hole 60 and right front axle hole 61 are aligned with each other, and left rear axle hole 70 and right rear axle hole 71 are aligned with each other. This allows for a front axle 160 to span left front axle hole 60 and right front axle hole 61 and a rear axle 161 to span left rear axle hole 70 and right rear axle hole 71.

Figure 4:
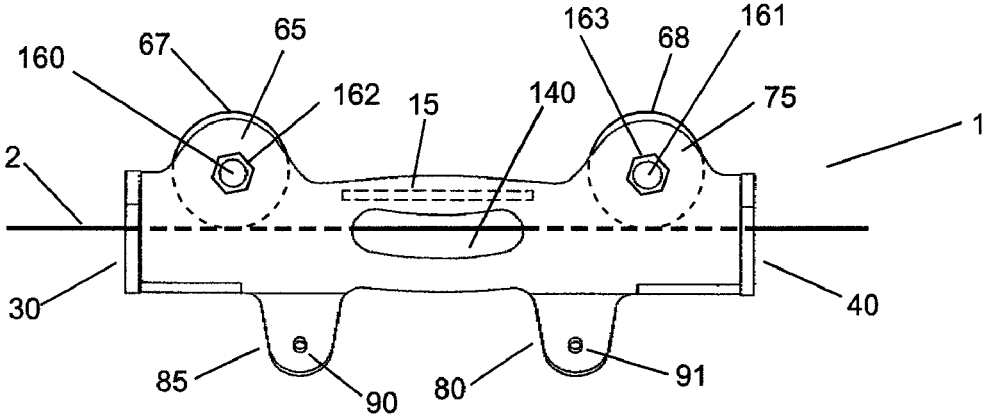
FIG. 4 is a front view of the upper frame of the trolley according to the preferred embodiment of the invention, with the wheels and zipline cable shown.
Figure 5:
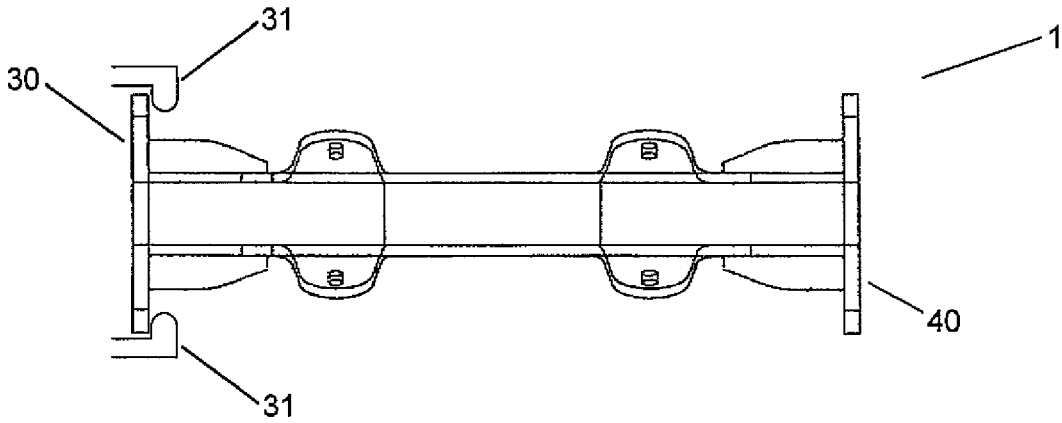
FIG. 5 is a bottom view of the upper frame of the trolley, with its front face engaged by the buckles.

Referring to FIG. 4, a front axle wheel 67 is attached to front axle 160 and sits in between left flange 10 and right flange 20. A rear axle wheel 68 is attached to rear axle 161 and sits in between left flange 10 and right flange 20. Front axle wheel 67 and rear axle wheel 68 ride on top of the suspended zipline cable 2. Front axle wheel 67 is attached to front axle 160 using a front nut and bolt connection 162, and rear axle wheel 68 is attached to rear axle 161 using a rear nut and bolt connection 163. Preferably, front and rear nut and bolt connections 162, 163 comprise stainless steel bolts and Nylock nuts to allow for easy removal of axle wheels 67, 68 for replacement.

The tracks of axle wheels 67, 68 are preferably grooved to allow for better tracking of axle wheels 67, 68 with the suspended zipline cable 2. Preferably, axle wheels 67, 68 are made of high-density urethane. The bottom of upper frame 1 is uncovered, to allow for easy placement of axle wheels 67, 68 of the trolley on top of zipline cable 2. Except for substantially flat member 15, the top of the trolley is uncovered, to reduce the overall weight of the trolley.

A left front projecting flange 85 and a left rear projecting flange 80 project from the bottom edge of left flange 10 and are spaced apart from each other. Similarly, a right front projecting flange 86 and a right rear projecting flange 81 project from the bottom edge of right flange 20 and are spaced apart from each other. Preferably, left front projecting flange 85 is aligned with right front projecting flange 86, and left rear projecting flange 80 is aligned with right rear projecting flange 81. Left front and left rear projecting flanges 85, 80 are at an angle from left flange 10 such that they project away from left flange 10. Similarly, right front and right rear projecting flanges 86, 81 are at an angle from the right flange 20 such that they project away from the right flange 20. Preferably, the projecting flanges 80, 81, 85, 86 project at an angle of approximately 25° away from vertical. Left front projecting flange 85 comprises a left front hole 90, left rear projecting flange 80 comprises a left rear hole 91, right front projecting flange 86 comprises a right front hole 92, and right rear projecting flange 81 comprises a right rear hole 93.

A lower frame 3 of the trolley comprises a first line 100, a second line 101, a third line 102, a fourth line 103, a left spreader 110, a right spreader 115, and a handlebar 130. The lines 100, 101, 102, 103 hang below upper frame 1. First line 100 is attached at one end to left front hole 90 and at the other end to a left front spreader hole 120 on left spreader 110. Second line 101 is attached at one end to left rear hole 91 and at the other end to a left rear spreader hole 121 on left spreader 110. Third line 102 is attached at one end to right front hole 92 and at the other end to a right front spreader hole 122 on right spreader 110. Fourth line 103 is attached at one end to right rear hold 93 and at the other end to a right rear spreader hole 123 on right spreader 110.

Preferably, the lines 100, 101, 102, 103 are attached to their respective holes using a connection found typically in lifeline connections, such as a swage eye toggle assembly. The use of such connections increases the strength of the connections compared with those of conventional crimped connections. Handlebar 130 spans left spreader 110 and right spreader 115. Preferably, handlebar 130 and left and right spreaders 110, 115 are made from aluminum. The left end of handlebar 130 is welded to left spreader 110 while the right end of handlebar 130 is welded to right spreader 115. By having the ends of handlebar 130 welded to left and right spreaders 110, 115, the overall weight of the trolley is reduced, as bolts or other connecting members are not required.

Left spreader 110 comprises a left sling hole 150, and right spreader 115 comprises a right sling hole 151. A sling is attached to left sling hole 150 and right sling hole 151 using a choker knot. The sling is removably attached to a modified paragliding harness that is worn by the zipline rider. The attachment of the harness to the sling ensures that the rider remains connected to the trolley at all times while it is in motion.

The angulation of lines 100, 101, 102, 103 with respect to vertical is determined in part by the length of lines 100, 101, 102, 103 and the width of handlebar 130. In one embodiment, the length of lines 100, 101, 102, 103 is approximately 16.5 inches (from centre of respective spreader holes to center of respective front holes and rear holes), and the length of handlebar 130 is approximately 18 inches. In this embodiment, the horizontal distance between left flange 10 and right flange 20 is approximately 1.5 inches. These dimensions comprise only one possible example; other dimensions may be used without departing from the principles of the invention. This angulation limits the degree of "swing-up" by left and right spreaders 110, 115 as the trolley travels along the length of zipline cable 2.

The axle wheels 67, 68 of the trolley allow it to travel smoothly over the suspended zipline cable 2. In order to stop the trolley (i.e. when it reaches the end of zipline cable 2), a catch block braking system may be used. The catch block braking system comprises two buckles 31 that snap around and grip the two side edges of flat front face 30 when the trolley impacts the buckles 31. A spring attached to the buckles 31 along the longitudinal direction of zipline cable 2 compresses and absorbs the impact of the trolley as it impacts on the buckles 31. The braking system prevents the spring from decompressing, and so the trolley is not propelled back.

Preferably, the top and bottom edges of front face 30 are substantially flat, while the side edges are rounded and protrude out from the side edges. The protruding side edges are gripped by the buckles 31 of the catch block braking system. Preferably, the outer rims of the side edges of front face 30 are rounded or flared to allow the buckles 31 to slide over and grip the sides easier. To disengage the trolley from the buckles 31 of the catch block braking system, the frame of the trolley is rotated 90 .degree. about the longitudinal axis of zipline cable 2 (so that the substantially flat edges of front face 30 formerly on the top and bottom are now on the sides). Since the buckles 31 are fixed to the braking system and cannot rotate, the buckles 31 disengage from the trolley because they can no longer grip onto the substantially flat edges of front face 30. Upper frame 1 of the trolley can then be removed from zipline cable 2.

In another embodiment of the invention, in order to remove the trolley from the cable, handlebar 130 can be separated at the middle. Once handlebar 130 has been separated, the entire trolley can then be removed by detaching upper frame 1 from zipline cable 2 and by swinging the lines on one side of the trolley over zipline cable 2.

Preferably, left flange 10 and right flange 20 each comprise one or more holes 140 to allow for upper frame 1 of the trolley to be easily grasped by a hand.

Preferably, the trolley is of a symmetrical shape such that the front and rear ends of the trolley are mirror images of each other. If the front and rear ends of the trolley are mirror images of each other, then the trolley can be oriented in either direction and still allow the braking system to work as intended. The left and right sides of the trolley are preferably also mirror images of each other as well.

The connections for the axles 160, 161 and the lines 100, 101, 102, 103 are designed for easy disconnection. This allows the axles 160, 161 (and axle wheels 67, 68) and the lines 100, 101, 102, 103, 104 to be easily removed for inspection and/or replacement.

It will be appreciated by those skilled in the art that the preferred and alternative embodiments have been described in some detail but that certain modifications may be practiced without departing from the principles of the invention.

What is claimed is:

1. A zipline trolley comprising:

a substantially flat first side flange;

a substantially flat second side flange, wherein said first side flange and second side flange are arranged in a parallel configuration;

a substantially flat front face attached perpendicularly to the front edges of said first and second side flanges, and wherein said substantially flat front face extends beyond the width between said first and second side flanges;

a substantially flat back face attached perpendicularly to the rear edges of said first and second side flanges, and wherein said substantially flat back face extends beyond the width between said first and second flanges;

two axles for bearing wheels extending between said first side flange and said second side flange;

four lines, comprising first two lines, wherein one end of each of said first two lines is attached to said first side flange; and second two lines, wherein one end of each of said second two lines is attached to said second side flange;

a first spreader, wherein said first spreader is attached to the other end of each of said first two lines;

a second spreader, wherein said second spreader is attached to the other end of each of said second two lines; and a handlebar, wherein said handlebar is rigidly attached to said first spreader and said second spreader.

2. The zipline trolley of claim 1, wherein said two axles are attached to said wheels using a bolt and nut connection.

3. The zipline trolley of claim 1, wherein said first two lines project at an angle to said first side flange and said second two lines project at an angle to said second side flange.

4. The zipline trolley of claim 1, wherein said first two lines are attached to said first side flange by a swage eye toggle assembly and said second two lines are attached to said second side flange by a swage eye toggle assembly.

5. The zipline trolley of claim 1, wherein said first two lines are attached to said first spreader by a swage eye toggle assembly and said second two lines are attached to said second spreader by a swage eye toggle assembly.

6. The zipline trolley of claim 1, wherein said first two lines are attached to said first side flange by a lifeline connection and said second two lines are attached to said second side flange by a lifeline connection.

7. The zipline trolley of claim 1, wherein said first two lines are attached to said first spreader by a lifeline connection and said second two lines are attached to said second spreader by a lifeline connection.

8. The zipline trolley of claim 1, wherein said spreaders are weldedly connected to said handlebar.

9. The zipline trolley of claim 1, wherein said front face is adapted to engage two buckles when said zipline trolley is braking.

10. The zipline trolley of claim 1, wherein said first side flange and said second side flange each comprise one or more holes adapted for gripping said zipline trolley.

11. The zipline trolley of claim 1, wherein the top and bottom edges of said substantially flat front face are substantially straight.

12. The zipline trolley of claim 11, wherein the side edges of said substantially flat front face are rounded.

13. The zipline trolley of claim 1, wherein the top and bottom edges of said substantially flat back face are substantially straight.

14. The zipline trolley of claim 13, wherein the side edges of said substantially flat back face are rounded.

15. The zipline trolley of claim 1 further comprising a substantially flat member extending perpendicularly between said first side flange and said second side flange.

* * * * *